US009759447B1

(12) United States Patent
Mathur

(10) Patent No.: US 9,759,447 B1
(45) Date of Patent: Sep. 12, 2017

(54) ACOUSTIC METAMATERIAL NOISE CONTROL METHOD AND APPARATUS FOR DUCTED SYSTEMS

(71) Applicant: Acoustic Metameterials, Inc., Brooklyn, NY (US)

(72) Inventor: Gopal P. Mathur, Trabuco Canyon, CA (US)

(73) Assignee: Acoustic Metameterials, Inc., Brooklyn, NY (US)

( * ) Notice: Subject to any disclaimer, the term of this patent is extended or adjusted under 35 U.S.C. 154(b) by 0 days.

(21) Appl. No.: 15/069,147

(22) Filed: Mar. 14, 2016

(51) Int. Cl.

| | |
|---|---|
| ***G10K 11/00*** | (2006.01) |
| ***F24F 13/24*** | (2006.01) |
| ***G10K 11/16*** | (2006.01) |
| ***G10K 11/168*** | (2006.01) |

(52) U.S. Cl.
CPC ..... *F24F 13/24* (2013.01); *G10K 11/161* (2013.01); *G10K 11/168* (2013.01); *F24F 2013/242* (2013.01); *F24F 2013/245* (2013.01)

(58) Field of Classification Search
CPC ..... F24F 13/24; G10K 11/161; G10K 11/168
USPC ..... 181/224
See application file for complete search history.

(56) References Cited

U.S. PATENT DOCUMENTS

| | | | | |
|---|---|---|---|---|
| 6,116,375 | A * | 9/2000 | Lorch | G10K 11/172 181/224 |
| 2010/0077755 | A1* | 4/2010 | Jangili | F01D 25/30 60/725 |
| 2012/0055735 | A1* | 3/2012 | Lu | G10K 11/26 181/252 |
| 2012/0064285 | A1* | 3/2012 | Mathur | B32B 3/12 428/116 |
| 2015/0279345 | A1* | 10/2015 | Mathur | G10K 11/162 181/294 |
| 2016/0195299 | A1* | 7/2016 | Lind | F24F 7/04 181/224 |

* cited by examiner

*Primary Examiner* — Forrest M Phillips
(74) *Attorney, Agent, or Firm* — Michael J. Feigin, Esq.; Feigin & Fridman

(57) ABSTRACT

An acoustic metamaterial noise control system of embodiments of the disclosed technology combines acoustic metamaterial principles with absorptive materials, with a result of a significant reduction in sound radiation within, or emanating from, an HVAC duct. Sound waves that impinge on the noise control system placed at the end (terminal opening of an air duct to ambient space within a room/building), or at a predetermined place on the duct, cause the sound waves to reflect back to the start of the noise control system and also to be absorbed by sound waves within the absorptive core. This is accomplished by way of the use of micro-perforated panels (MPPs) placed in periodic manner with absorptive layers and air gaps to achieve anisotropic conditions to reflect and absorb sound waves for optimum sound reduction.

9 Claims, 5 Drawing Sheets

ACOUSTIC METAMATERIAL NOISE CONTROL METHOD AND APPARATUS FOR DUCTED SYSTEMS

FIELD OF THE DISCLOSED TECHNOLOGY

The present disclosure relates generally to noise reduction from ducts and more specifically to acoustic metamaterial usage in connection with such noise reduction.

BACKGROUND OF THE DISCLOSED TECHNOLOGY

HVAC (heating, ventilating, and air conditioning) systems typically use a series of ducts through which hot or cold air is passed in order to heat or cool a building. Traditionally, HVAC ductwork is made of sheet metal which is installed first and then wrapped with insulation as a secondary operation. Galvanized mild steel is the standard and most commonly used material in fabricating ductwork. The steel sheets are supplied conventionally in rolls of continuous metal sheets, with a standard width of 1.20 to 1.50 meters. The rolls are unrolled manually and cut in desired lengths. Then the lengths are bent together into a rectangular shape and locked together. Currently available flexible ducts, known as hex have a variety of configurations, but for HVAC applications, they are typically flexible plastic over a metal wire coil to make round, flexible ducts. However, such flex ducts have poor noise and thermal insulation characteristics. Light weight, superior noise attenuation and installation speed are among the main desired features of HVAC ducting.

In lightweight composite HVAC ducting, preserving lightweight and flexibility, while increasing acoustic resistance, is a difficult task. Sound can easily propagate through thin composite duct walls. As such, such systems tend to be noisy and disrupt the quality of life in a building while distracting the occupants. HVAC systems may use any one or more of pumps, compressors, chillers, air handlers, and generators which have moving or other mechanical components causing noise to emanate from the mechanical system itself as well as by way of the ducts. The ducts themselves generate additional noise due to air flow turbulence.

The most commonly known acoustic attenuation method for HVAC duct systems is a silencer/muffler. A silencer attenuates sound when it is directly inserted in the ducted path by using a series of perforated sheet metal baffles (rectangular silencers) or bullets (circular silencers) placed inside a silencer single or double wall outer solid shell. An absorptive silencer is the most commonly known type of silencer. It uses absorptive fibrous material within sound baffles or a sound bullet cavity with perforated sheet metal facings that allow sound energy to pass through and be absorbed by the fibrous fill. On the contrary, a reactive muffler uses the phenomenon of destructive interference and/or reflections to reduce noise. A reactive muffler generally consists of a series of expansion and resonating chambers that are designed to reduce sound at certain frequencies.

In either of the above types of mufflers, perforated tubing is used and quite beneficial when large flow velocities are seen inside the muffler. When an exhaust stream exits out of a tube within the muffler, a flow jet typically forms. In order to mitigate this effect, perforated tubing is used to steady the flow and force the flow to expand into the entire chamber. Perforated tubing can also be considered a dissipative element.

Perforated panels have also been used to attenuate sound in various noise control applications, such as ducts, exhaust systems and aircraft engines. One of the advantages of such acoustical materials is that their frequency resonances can be tuned depending on the goal it is desired to achieve. When the perforations are reduced to millimeter or sub-millimeter (micro-perforation) size, these materials can afford very interesting sound absorption without any additional classical absorbing material.

What is needed is a way to improve upon present technology mufflers used in HVAC duct systems, in order to better effectuate noise flow reduction while causing as little disruption to the flow of air through the ducts as possible.

SUMMARY OF THE DISCLOSED TECHNOLOGY

The disclosed technology reduces the aforementioned problems by providing a metamaterial block which is in line with an air duct of an HVAC system to reduce noise. A stack of at least three perforated sheets of acoustically hard material is placed between an ambient medium forming anisotropic air flow from or to an air duct and through each of the at least three perforated sheets. The ambient medium can be air. Each perforated sheet is less than, or equal to, 2 mm thick, in embodiments of the disclosed technology. A diameter of each perforation of each said perforated sheet is between 0.1 and 0.4 mm, in an embodiment of the disclosed technology. Each perforated sheet of the at least three perforated sheets is spaced apart from at least one other perforated sheet between 0.5 to 55 mm, in an embodiment of the disclosed technology. The spaced-apart distance of the at least three perforated sheets and the diameter of each perforation can be determined based on a Jacobian transformation defined by the formulae listed in the detailed description.

"Substantially" and "substantially shown," for purposes of this specification, are defined as "at least 90%," or as otherwise indicated. Any device may "comprise" or "consist of" the devices mentioned there-in, as limited by the claims.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

Figure 1:
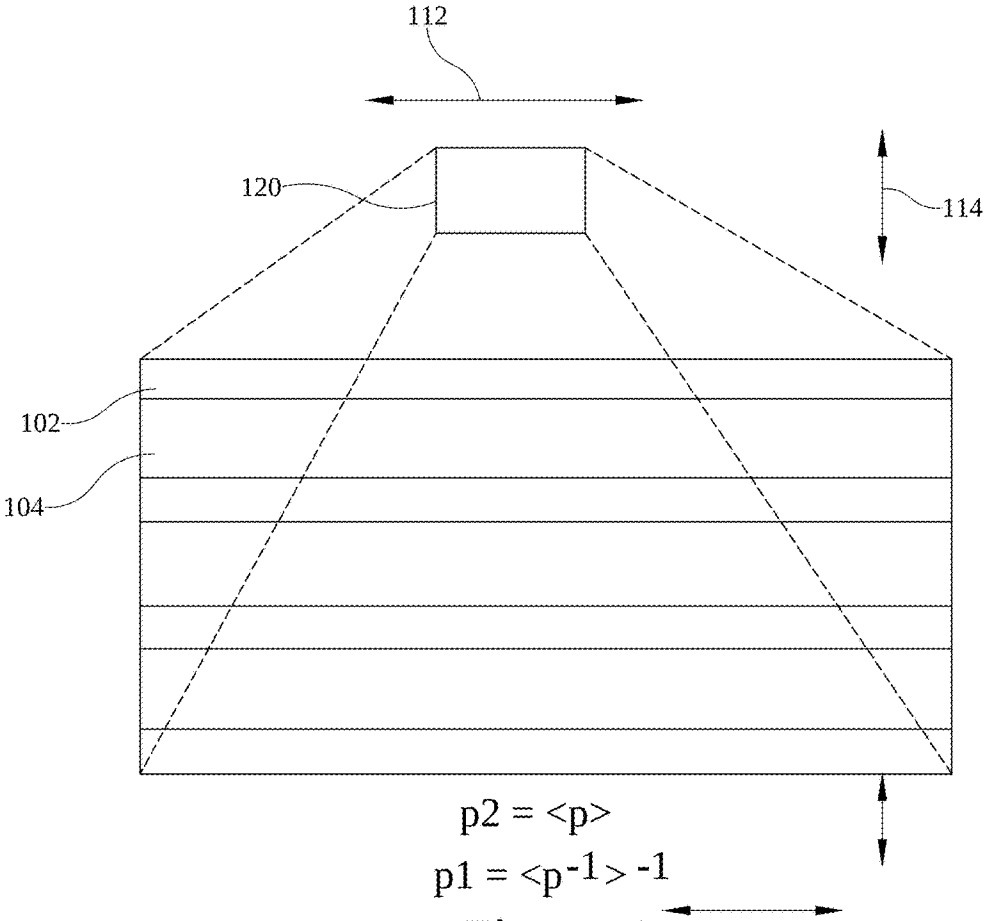
FIG. 1 shows a diagram of acoustic metamaterial with anisotropic inertia, used in embodiments of the disclosed technology.

An acoustic metamaterial noise control system of embodiments of the disclosed technology combines absorptive materials with acoustic metamaterial principles, with a result of a significant reduction in sound radiation within, or emanating from, an HVAC duct. Sound waves that hit the noise control system placed at the end of the duct cause the sound waves to reflect back to the start of the noise control system and to be absorbed by sound waves within the absorptive core. This is accomplished by way of the use of micro-perforated panels (MPPs) for sound absorption. For purposes of this disclosure, an MPP is defined as a device used to absorb sound and reduce sound intensity comprised of, or consisting of, a thin flat plate less than, or equal to, 2 mm thick, with a hole diameter between 0.1 and 0.4 mm.

Perforations in the acoustic metamaterial provide acoustic metamaterial anisotropic (directionally dependent) characteristics of the core of the material. Using acoustic metamaterial principles, the noise control system can operate at lower frequencies and also over a broader frequency range than known in the prior art. Acoustic metamaterials are engineered material systems containing embedded periodic resonant or non-resonant elements which modify the acoustic properties of the material either by added dynamics or by wave scattering. Typical prior art ranges of frequencies are 100 Hz, with a lowest range of 10,000 Hz, similar to the frequency range for the present technology with a lowest range of 100 Hz. However, present technology, based on conventional isotropic acoustics theory, has severe limitations in the lower frequency region (<500 Hz) which can only be solved by increasing thickness and or other parameters of the absorptive material, making it costly, heavy, and thus prohibitive.

The acoustic metamaterial noise control system can be positioned or placed at the beginning or end of the ducting to reduce the noise radiating out of the end of the HVAC ducting. Absorptive lining (defined as a sheet of material with a thickness between 0.1 and 5 mm) periodically placed inside the metamaterial noise control system around the interior spaces further enhances noise reduction over broadband frequency range.

The following principles are used in conjunction with embodiments of the disclosed technology. Transformation acoustics is a mathematical tool which completely specifies the material parameters needed to control the wave propagation through the material. It allows control over a two-dimensional acoustic space with anisotropic characteristics. A transformation from the real (r) space described by the (x, y, z) coordinates to the desired, virtual (v) space specified by the (u, v, w) coordinates is shown below.

$$\acute{\rho}^{r} = \frac{\det(J)(J^{-1})^{T}}{J}\acute{\rho}^{v}$$

$$\acute{\kappa}^{r}=\det(J)\acute{\kappa}^{v}$$

$$J = \begin{pmatrix} \frac{\partial u}{\partial x} & \frac{\partial u}{\partial y} & \frac{\partial u}{\partial z} \\ \frac{\partial v}{\partial x} & \frac{\partial v}{\partial y} & \frac{\partial v}{\partial z} \\ \frac{\partial w}{\partial x} & \frac{\partial w}{\partial y} & \frac{\partial w}{\partial z} \end{pmatrix}^{-1}$$

$$as,\ J = \frac{\partial(x, y, z)}{\partial(u, v, w)} = \left[\frac{\partial(u, v, w)}{\partial(x, y, z)}\right]^{-1}$$

Here, ρ is fluid mass density and κ is fluid bulk modulus, r and v superscripts denote the real and virtual spaces, and J is Jacobian transformation.

FIG. 1 shows a diagram of acoustic metamaterial with anisotropic inertia, used in embodiments of the disclosed technology. Using the transformation acoustics (TA) approach, the densities and bulk modulus in two dimensions on a structure can be engineered to be anisotropic. In FIG. 1, 120 indicates a two-dimensional metamaterial block having anisotropic characteristics with two different densities, $\rho_1$, $\rho_2$ along two directions 112 (x-axis) and 114 (y-axis). In conventional, isotropic acoustics, these densities are assumed to be the same in two directions. 102 and 104 show layered media, with 102 being one fluid medium (e.g., air) whereas the layer 104 is made of a different material, such as aluminum, or plastic usually having a greatly different acoustic impedance than 102.

Figure 2B:
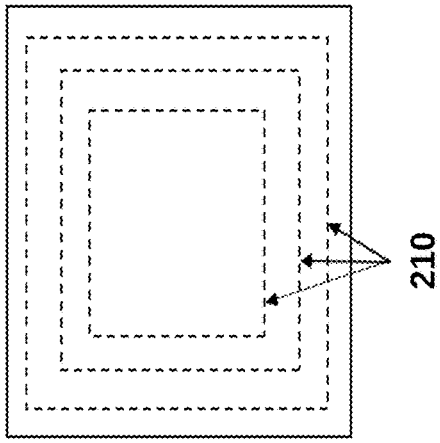
FIG. 2B shows a cross-section of the rectangular area of the muffler of FIG. 2A.
Figure 2A:
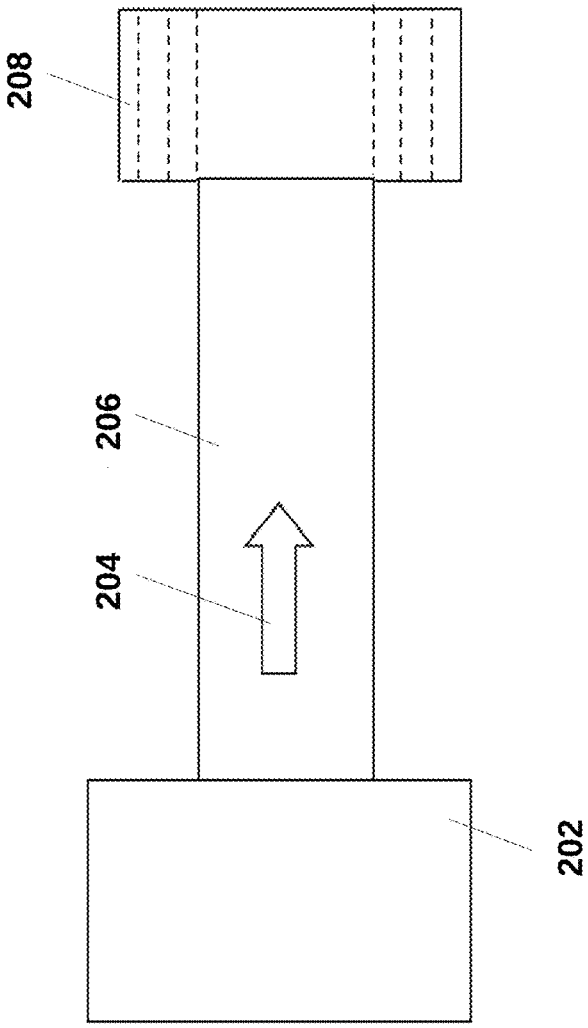
FIG. 2A shows a diagram of an acoustic metamaterial noise control system, with rectangular muffler placed at the end of a duct to reduce noise, in embodiments of the disclosed technology.

FIG. 2A shows a diagram of an acoustic metamaterial noise control system, with a rectangular muffler placed at the end of a duct to reduce noise, in embodiments of the disclosed technology. FIG. 2B shows a cross-section of the rectangular area of the muffler of FIG. 2A. A noise source 202, such as a fan, motor, impeller, or other moving or rotating part of an HVAC system propagates sound waves 204 through a duct 206 into a metamaterial structure 208. The metamaterial design comprises a stack of perforated sheets 210 made of an acoustically hard material, defined as a surface having almost infinite acoustic impedance (greater than 1*10^7 kg/(m2s)) compared to the characteristic impedance of the ambient medium, separated by a sound-supporting fluid (e.g., air), The elementary constituent parts of the stack of plates is a 2D rigid hole array, shielding sound near the onset of diffraction. Such a structure thus can be made practical by fabricating it out of micro-perforated panels (MPP) which allow anisotropic variables to be achieved.

Figure 3B:
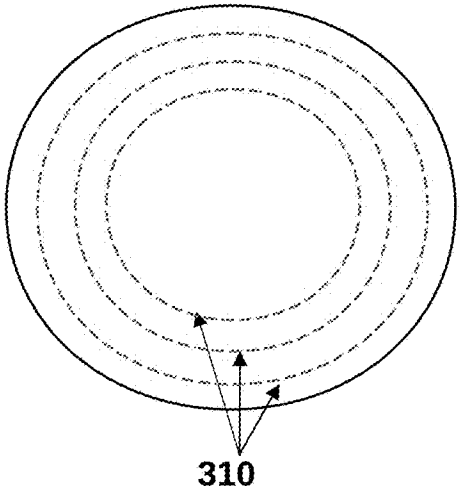
FIG. 3B shows a cross-section of the circular area of the muffler of FIG. 3A.
Figure 3A:
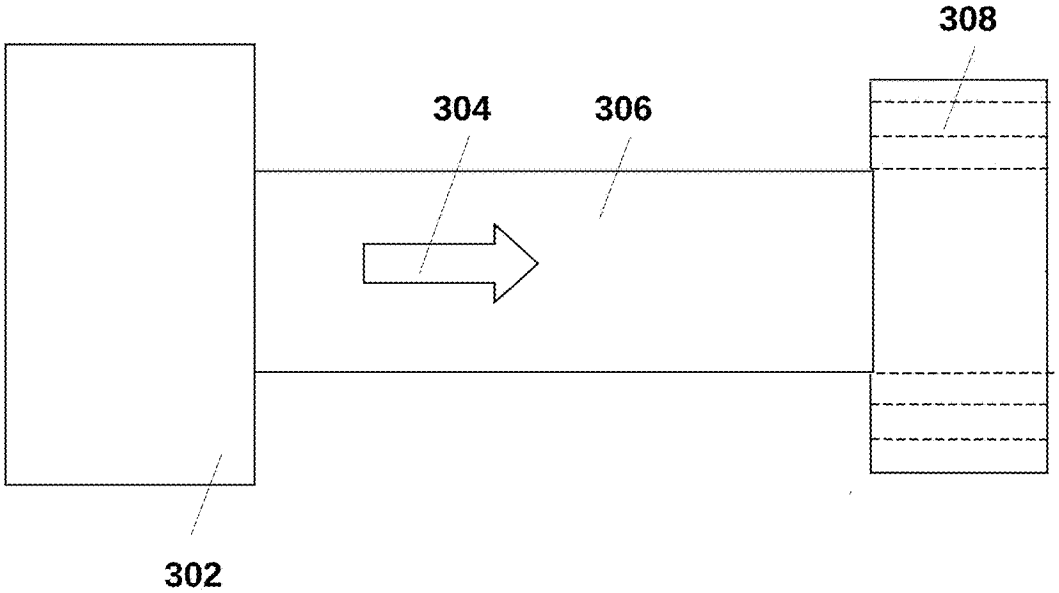
FIG. 3A shows the diagram of FIG. 2B with a circular muffler placed at the end of a duct to reduce noise, in embodiments of the disclosed technology.

FIG. 3A shows the diagram of FIG. 2B with a circular muffler placed at the end of a duct to reduce noise, in embodiments of the disclosed technology. FIG. 3B shows a cross-section of the circular area of the muffler of FIG. 3A. Here, elements of FIGS. 2A and 2B have been incremented by 100. Thus, the noise-producing region 302 causes sound waves 304 to flow through an HVAC duct 306 into the muffler 308. The muffler 308 has a curricular cross-section, in this embodiment, with a series of perforated sheets 310.

Figure 4:
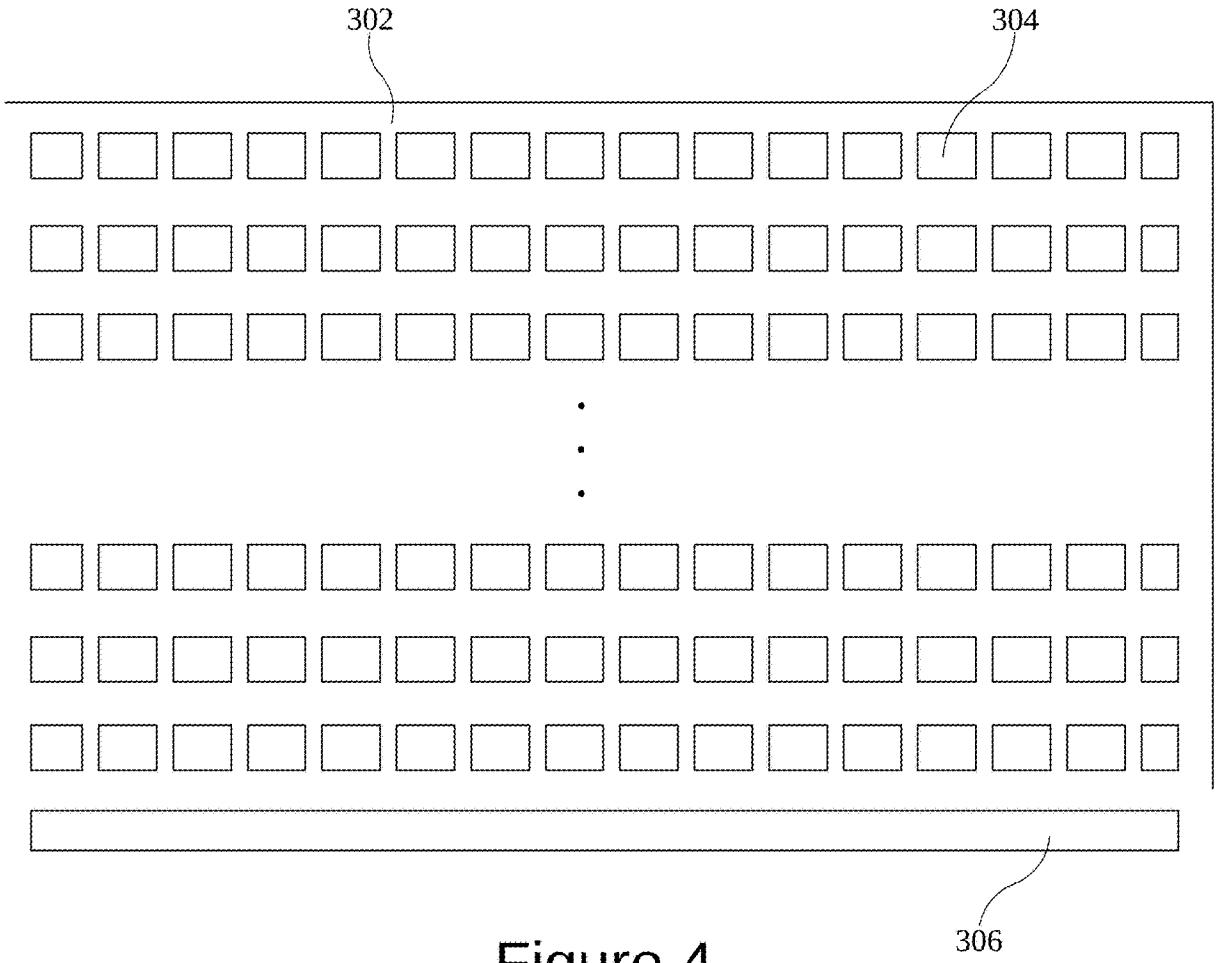
FIG. 4 shows an acoustic metameterial block formed by a periodic stack of micro-perforated panels, used in embodiments of the disclosed technology.

FIG. 4 shows an acoustic metamaterial block formed by a periodic stack of micro-perforated panels, used in embodiments of the disclosed technology. It has been shown that these metamaterial blocks with perforated stacks exhibit broad-angle negative refraction, unlike fishnet electromagnetic metamaterials, which operate within narrow angular ranges. The proposed metamaterials also do not rely on diffraction to achieve negative refraction, in contrast to phonon crystals. Each perforated layer in this figure indicates a layer made of a hard material or surface, having much higher acoustic impedance (defined as "greater than 1000 times") than the adjoining layer, which is usually the ambient medium, such as air. In this layer, 302 indicates a hole of a certain diameter and spacing from the next hole, whereas 304 denotes the hard material or unperforated part. of the layer.

Figure 5:
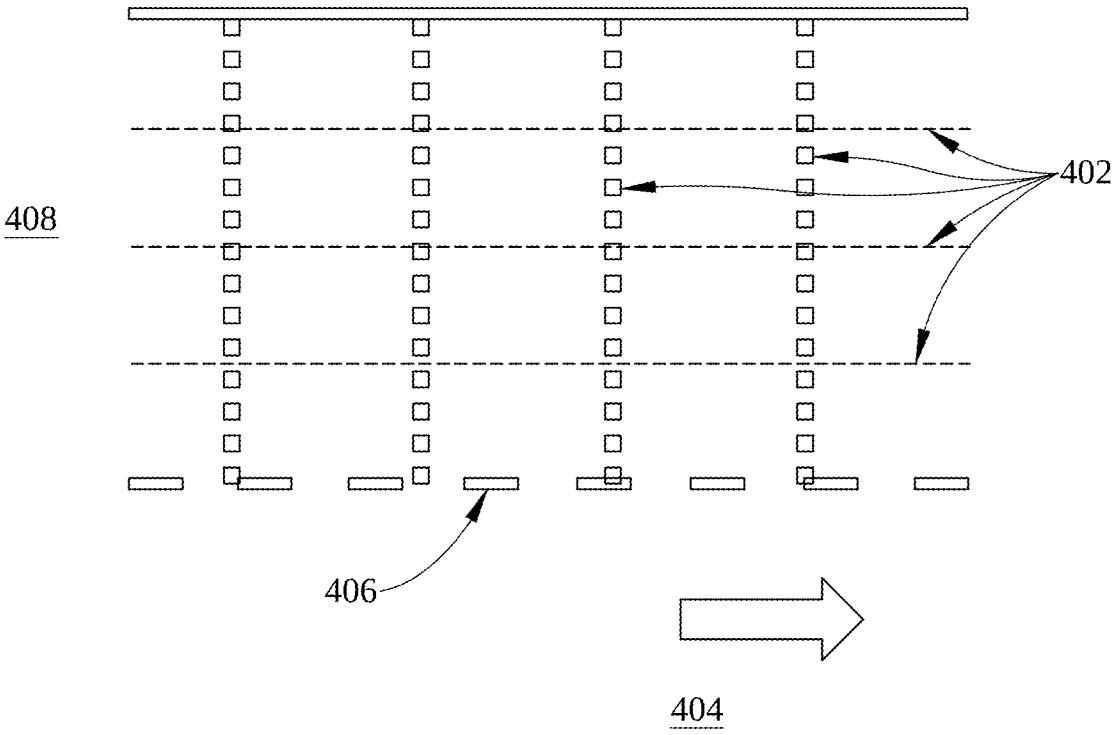
FIG. 5 shows an acoustic metamaterial liner formed by micro perforated sheets.

FIG. 5 shows an acoustic metamaterial muffler configuration formed by micro-perforated sheets. A face sheet 406 has a plurality of perforations, as do the plurality of perforated sheets 402 extending parallel and perpendicular to each other in a lattice formation between the face sheet 406 and a back sheet 408.

Since the material parameters for the metamaterial panel are given by the first partial derivatives of the transformation functions, in order to obtain a homogeneous perforated MPP panel, the transformation functions are linear. One such choice suitable for the rectangular object considered here is:

$$u=x,$$

$$v=y$$

$$w=w_z z$$

It is to be noted that the expression of v may not be linear inside the whole transformation domain; however, it is linear inside each one of the x<0 and x>0 domains. This translates into same material parameters in each half of the metamaterial panel, but different directions of the principal axis, defined as the directions along which the material parameter tensors are diagonal. The constant $w_z$ represents a degree of freedom that allows for a tradeoff in performance for fabrication simplicity.

The material parameters inside the metamaterial MPP panel, i.e., mass density pseudotensor and bulk modulus, are given by . . . >>>(Equation . . . below)

$$J^{-1}$$

¿

¿

$$\rho=\det(J)¿$$

where $\rho_0$=1.29 kg/m$^3$ and $B_0$=0.15 MPa are the parameters of air, and J is the transformation Jacobian:

$$J=\frac{\partial(x,y,z)}{\partial(u,v,w)}=\left[\frac{\partial(u,v,w)}{\partial(x,y,z)}\right]^{-1}.$$

According to the coordinate transformation theory, the mapping functions given by the above translate to the following material parameters:

$$\rho_{11}^{pr}=K_1\rho_0,$$

$$\rho_{22}^{pr}=K_2\rho_0,$$

$$B^{pr}=K_3B_0,$$

$$a=\alpha^{\circ}. \quad (3)$$

Here $K_1$, $K_2$, $K_3$ are constants. To obtain anisotropic metamaterial, perforated plastic plates are used. The size and shape of the perforation determines the momentum in the rigid plate produced by a wave propagating perpendicular on the plate, and, therefore, can he used to control the corresponding mass density component seen by this wave. This property is used to obtain the higher density component. If, on the other hand, the wave propagates parallel to the plate, it will have a very small influence on it, and, consequently, the wave will see a density close to that of the background fluid. The compressibility of the cell, quantified by the second effective parameter, the bulk modulus, is controlled by the fractional volume occupied by the plastic plate.

Expressed in another way, using perforated sheets with acoustically absorbent layers and air gaps in anisotripic metamaterial systems is manipulated by the size and shape of the perforations of the perforated sheets. The spacing between sheets is 0.5 to 55 mm, with a sheet thickness between 0.1 and 0.5 mm. The percentage open areas for perforated sheets are between 0.1 and 2% open. An absorptive layer whose thickness is between. 0.5 and 55 m can also be used. This determines the momentum of air particles in the sheets, produced by a wave-propagating perpendicular on the sheets as designed and optimized. The thickness and number of acoustically absorbent layers are also optimized, using metamaterial principles as follows: The perforated anisotropic metamaterial layers and absorptive layers of a particular thickness are arranged in a periodic manner, as shown in FIG. 1, to achieve anisotropic properties of the fluid in the area directly next to the face sheet (see FIGS. 4 and 5). In this manner, the sound in air can be fully and effectively manipulated, using realizable transformation acoustics devices. All the geometric parameters of perforated layers and absorptive layers are determined, using numerical simulation based on equations above. This approach can be used to design a duct noise control system to control and manipulate sound waves for the purpose of enhancing noise attenuation, although the required material parameters are highly anisotropic.

Another innovative feature of the duct noise control system is that it can he designed using periodic arrangement of noise blocking and/or reflecting (i.e., perforated layers) and noise absorbing MPP layers separated by air gaps. The parameters of each of the constitutive elements of the system are: hole diameter, sheet thickness, hole spacing, POA (percent open area), absorbing layer sheet thickness, absorptive layer parameters including porosity, tortuosity, flow resistivity, density, viscous and thermal characteristic lengths, etc. The spacing between each MPP layer and the absorptive layer thickness is determined by rnetarnaterial theory described herein. Acoustical characteristics of noise blocking and/or reflecting or noise absorbing MPP layer etermined by suitably designed hole patterns using metamaterial theory.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A metamaterial muffler forming an acoustic metameterial noise control system comprising:

a stack of micro-perforated panels which are made up of at least three perforated sheets of acoustically hard material between an ambient medium forming anisotropic air flow from or to an air duct through each of said at least three perforated sheets.

2. The metamaterial muffler of claim 1, wherein said ambient medium is air and can be any fluid supporting sound wave propagation.

3. The metamaterial of claim 1, wherein each perforated sheet of said at least three perforated sheets is less than, or equal to, 2 mm thick.

4. The metameterial muffler of claim 3, wherein a diameter of each perforation of each said perforated sheet is between 0.1 and 0.4 mm.

5. The metameterial muffler of claim 4, wherein each perforated sheet of said at least three perforated sheets is spaced apart from at least one other perforated sheet between 0.5 to 55 mm.

6. The metamaterial muffler of claim 4, wherein said spaced-apart distance of said at least three perforated sheets and said diameter of each said perforation are determined based on transformation acoustic, using a Jacobian transformation defined by the formula $$J = \frac{\partial(x, y, z)}{\partial(u, v, w)} = \left[\frac{\partial(u, v, w)}{\partial(x, y, z)}^{-1}\right].$$

7. The metamaterial muffler of claim 4, wherein said muffler is placed at a beginning of an air duct adjacent to a noise source.

8. The metamaterial muffler of claim 4, wherein said muffler is placed at an end of an air duct adjacent to a terminal opening in said air duct.

9. The metamaterial muffler of claim 4, wherein said muffler conforms to a shape of a duct.

* * * * *